US005138782A

United States Patent [19]

Mizobe

[11] Patent Number: 5,138,782

[45] Date of Patent: Aug. 18, 1992

[54] DISPLAY PLATE

[75] Inventor: Tatsuji Mizobe, Ichikawa, Japan

[73] Assignee: Yonmarugo Incorporated, Tokyo, Japan

[21] Appl. No.: 519,173

[22] Filed: May 4, 1990

[30] Foreign Application Priority Data

Sep. 26, 1989 [JP] Japan ..... 1-112314[U]

[51] Int. Cl.[5] ..... G09F 13/04

[52] U.S. Cl. ..... 40/541; 40/219

[58] Field of Search ..... 40/541, 546, 547, 580, 40/219

[56] References Cited

U.S. PATENT DOCUMENTS

| | | | |
|---|---|---|---|
| 2,749,541 | 6/1956 | Whittlesey | 40/219 |
| 2,767,498 | 10/1956 | Bladh | 40/546 |
| 2,795,069 | 6/1957 | Hardesty | 40/546 |
| 2,906,048 | 9/1959 | Kraus | 40/546 X |
| 3,332,161 | 7/1967 | Hardesty | 40/546 |
| 4,240,220 | 12/1980 | Smith | 40/580 X |
| 4,729,068 | 3/1988 | Ohe | 40/448 X |
| 4,811,507 | 3/1989 | Blanchet | 40/546 |
| 4,860,171 | 8/1989 | Kojima | 40/546 X |

FOREIGN PATENT DOCUMENTS

| | | | |
|---|---|---|---|
| 500566 | 10/1929 | Fed. Rep. of Germany | 40/219 |
| 28391 | 10/1897 | United Kingdom | 40/219 |
| 392608 | 5/1933 | United Kingdom | 40/580 |

*Primary Examiner*—Kenneth J. Dorner
*Assistant Examiner*—J. Bonifanti
*Attorney, Agent, or Firm*—Cushman, Darby & Cushman

[57] ABSTRACT

A display plate preferably employable for an automotive vehicle for the purpose of displaying a certain name or providing a decorative effect is disclosed. The display plate includes a main body to be secured to a vehicle body of the automotive vehicle. A transparent base plate molded of transparent resin material is received in a cavity of the main body. A plurality of half mirrors corresponding to a content to be displayed are formed on the transparent base plate. A prism plate is disposed behind the transparent base plate and a plurality of light reflecting layers each comprising a number of dots or lines are formed on the prism plate. A color filter is interposed between the transparent base plate and the prism plate to scatter light therefrom. To generate light to be emitted from the front surface of the transparent base plate, a lamp is received in a cavity of the prism plate. A light density per unit area on each light reflective layer increases more and more as a distance from the lamp increases.

9 Claims, 3 Drawing Sheets

DISPLAY PLATE

BACKGROUND OF THE INVENTION

1. Technical Field of the Invention

The present invention relates generally to a display plate. More particularly, the present invention relates to a display plate preferably employable for an automotive vehicles for the purpose of displaying a certain name or providing a decorative effect.

2. Description of the Background Art

Conventionally, most of display plates are produced such that a certain image pattern is painted on a back sheet using paint or a certain image pattern corresponding to a content to be displayed is punched out from a metallic plate or the punched piece is coated or lined with glass or synthetic resin. Such a conventional display plate is often used in various fields for the purpose of displaying a certain name for an automotive vehicle or providing a decorative effect.

However, in recent years, decoration for an automotive vehicle has been progressively changed to meet a requirement for a variety of styles of individual user. Indeed, these styles are based on a motif for matching with modern feeling of individual user. Consequently, there arises a problem that the conventional display plate fails to satisfactorily harmonize with the requirement for modern style. In other words, the conventional display plate produced by, e.g., a punching operation has a feeling of heavy weight derived from metallic material as raw material but such feeling of heavy weight does not harmonize with whole decoration of a modern automotive vehicle. As a result, the conventional display plate has a drawback that a decorative effect is reduced to a level of half due to unbalance caused by the incomplete harmonization as described above.

SUMMARY OF THE INVENTION

The present invention has been made with the foregoing background in mind and its object resides in providing a display plate which assures that a requirement for a modern decorative effect can satisfactorily met with an excellent appearance.

To accomplish the above object, there is provided according to one aspect of the present invention a display plate preferably employable for an automotive vehicle. The display plate comprises a main body to be secured to a vehicle body of the automotive vehicle, a transparent base plate molded of transparent resin material. The transparent base plate is received in a fitting portion in the form of a cavity and provided with a plurality of half mirrors. The contour of which is determined corresponding to a content to be displayed. Other parts of the transparent base plate, exclusive of the half mirrors, are coated with opaque paint. A prism plate is attached to the rear surface of the transparent base plate. The prism plate is formed with a plurality of light reflecting layers on the rear surface thereof in such a manner that a light density per unit area on each light reflecting layer increases as a function of the distance from a lamp. A color filter is interposed between the transparent base plate and the prism plate. One surface of the color filter is prepared in such a manner as to scatter light therefrom. A lamp is received in a cavity of the prism plate at the central part of the transparent base plate to emit light in the direction at a right angle relative to a width of the display plate.

Each light reflecting layers on the prism plate comprises a plurality of dots. Alternatively, each light reflecting layer on the prism plate may comprise a plurality of lines.

A heat radiating plate serving also as a light reflecting plate is additionally disposed behind the rear surface of the prism plate for holding the lamp from the back side.

Further, according to another aspect of the present invention, there is provided a display plate preferably employable for an automotive vehicle for displaying a certain name or a certain image pattern. The display plate comprises an elongated transparent base plate. The sectional shape is contoured in a cup-shaped configuration. The transparent base plate includes a content to be displayed in the form of an image pattern or characters projecting forward of the front surface thereof. The transparent base plate is formed with a plurality of half mirrors on the rear surface thereof corresponding to the content or Figure to be displayed. Other parts of the transparent base plate exclusive of the half mirrors are coated with opaque ink. A prism plate of transparent resin material is received in a cup-shaped cavity of the transparent base plate. The prism plate has a plurality of light reflecting layers formed on the rear surface thereof in such a manner that the light density per unit area on each light reflecting layer increases as the function of the distance from each lamp increases. The color filter is interposed between the transparent base plate and the prism plate. One surface of the color filter is prepared in such a manner as to scatter light therefrom. Two lamps are disposed at opposite ends of the transparent base plate to emit light in the direction at a right angle relative to the display plate.

A printed wiring board is additionally disposed behind the rear surface of the prism plate to provide a lamp activating circuit for the lamps. One surface of the printed wiring board adapted to come in contact with the prism plate is coated with ink having a high light reflecting coefficient to build a light reflecting layer so as to allow the light reflecting layer to serve also as a light reflecting plate.

A back plate made of metallic material having an excellent heat conductivity is attached to the rear surface of the printed wiring board to serve as a heat radiating plate.

Other objects, features and advantages of the present invention will become apparent from reading of the following description which has been made with reference to the accompanying drawings.

BRIEF DESCRIPTION OF THE DRAWINGS

The present invention is illustrated in the following drawings in which:

FIGS. 3 and 3A are fragmentary views of the display plate, particularly illustrating an essential part on the rear surface of a prism plate.

DESCRIPTION OF THE PREFERRED EMBODIMENT

Now, the present invention will be described in detail hereinafter with reference to the accompanying drawings which illustrate preferred embodiments thereof.

Figure 1:
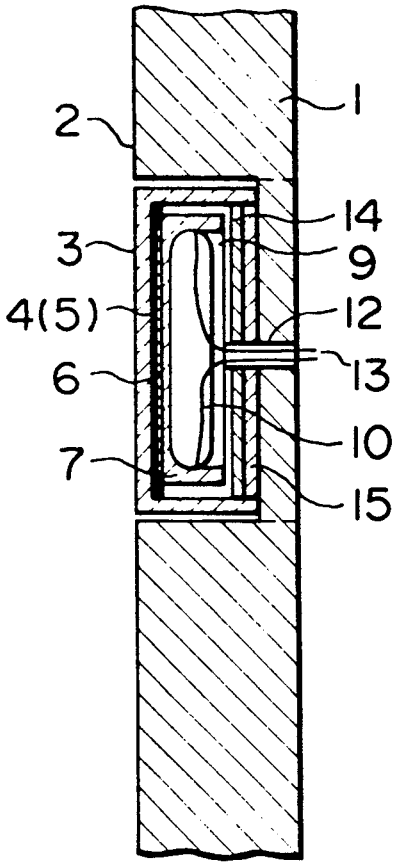
FIG. 1 is a sectional view of a display plate in accordance with a first embodiment of the present invention.
Figure 2:
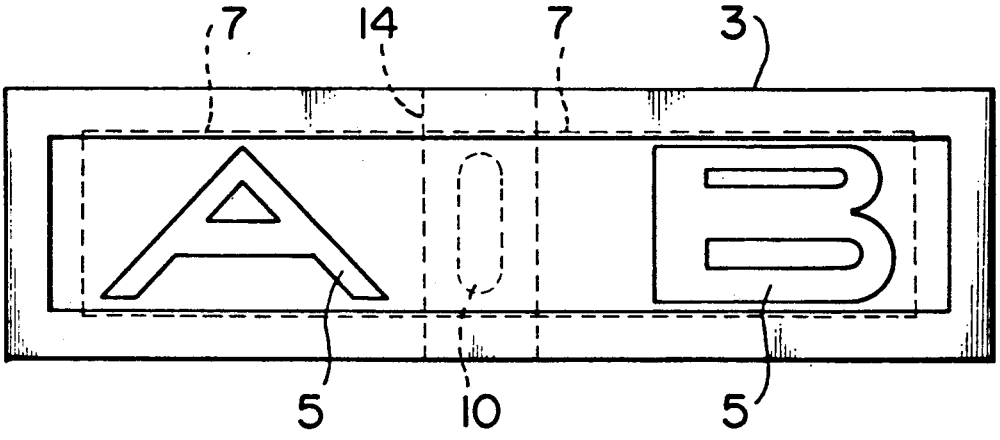
FIG. 2 is a front view of the display plate in FIG. 1.
Figure 3:
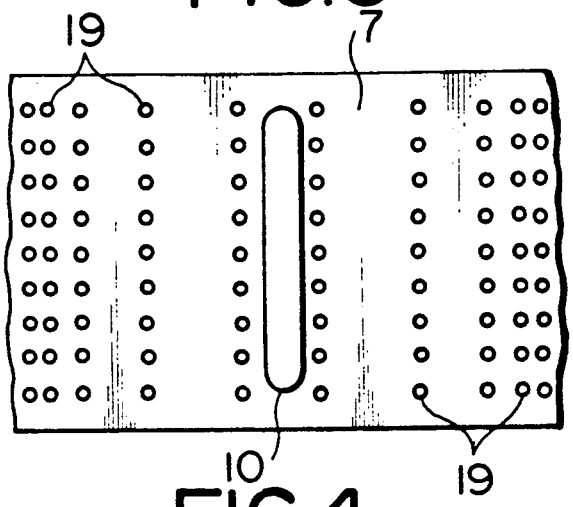

FIGS. 1 to 3A illustrate a display plate in accordance with a first embodiment of the present invention, respectively. In FIG. 1, reference numeral 1 designates a main body to which the display plate is attached. The main body 1 includes a fitting portion 2 at a properly determined position. A transparent base plate 3 molded of acrylic resin or the like material as shown in FIG. 2 is fitted in the fitting portion 2 in the form of a rectangular cavity. An opaque portion 4 exclusive of characters representative of a certain name (inclusive of a certain image pattern or figure pattern) on the rear surface of the transparent base plate 3 is coated with opaque paint or the like material. Name portions or character portions 5 are provided in the form of a plurality of half mirrors of which surface is plated with vaporized metallic material, respectively. A prism plate 7 is attached to the rear surface of the transparent base plate 3 with a color filter 6 serving to scatter light interposed therebetween. One surface of the color filter 6 is prepared in a pearlgrained or frost "glass-like" state in order to scatter light therefrom. The prism plate 7 is intended to emit light from a lamp to be described later toward the transparent base plate 3 through the color filter 6. The prism plate 7 is formed with a lamp receiving cavity 9 at a properly determined position so that a lamp 10 is received in the cavity 9. As shown in FIGS. 3 and 3A, the prism plate 7 is produced in such a manner that a light density per unit area (the number of dots or lines per unit area) increases more and more as a distance from the lamp 10 increases. The light density may be varied by changing a diameter of each of the dots or by changing a width of each of the lines. The prism plate 7 has a light reflecting layer 19 comprising a number of dots or lines over the rear surface thereof. The light reflecting layer 19 is formed on the rear surface of the prism plate 7 made of transparent synthetic resin, e.g., acrylic resin or the like material in accordance with a screen printing process using ink having a high light reflection coefficient. Specifically, the light reflecting layer 19 serves to uniformly emit light from the lamp 10 toward the color filter 6 as the light from the lamp 10 penetrates through the prism plate 7 and it is then reflected by the dots. Alternatively, a number of concave or convex dots or concave or convex lines may be substituted for the light reflecting layer 19 which is produced in accordance with the printing process. Also in this case, a light density per unit area may adequately be controlled depending on a distance of each of the dots or lines from the lamp 10 by changing a width of each of the dots or lines and a distance between adjacent dots or lines.

Usually, an incandescent lamp having a rod-shaped configuration is used for the lamp 10. However, the present invention should not be limited only to this. Alternatively, other types of lamp may be used for the lamp 10, provided that it illuminates with the same brightness as that of the incandescent lamp.

A heat radiating plate 14 serving also as a light reflecting plate is attached to the rear surface of the prism plate 7 for holding the lamp 10 from the back side. A width of the heat radiating plate 14 is set equal to a width of the region where the lamp 10 is arranged. Alternatively, a width of the heat radiating plate 14 may be equal to the whole width of the prism plate 7. In addition, a cover 15 is attached to the heat radiating plate 14 at a position rearward of the heat radiating plate 14. The heat radiating plate 14 and the cover 15 are formed with a hole 12, respectively, so that lead wires 13 of the lamp 10 are extended to the outside through the holes 12. The lead wires 13 of the lamp 10 are electrically connected to a lamp activating circuit (not shown).

It should be noted that a thickness of the display plate, i.e., a distance from the front surface of the transparent base plate 3 to the rear surface of the cover 15 is set within the range of 10 mm or less.

To assure that the lamp 10 may be replaced with a new one when necessary, the base body 3 may be formed with a window (not shown) on the rear surface thereof through which a new lamp is inserted in the cavity 9 with the aid of a lamp holder (not shown).

Next, operation of the display plate 1 as constructed in the above-described manner will be described below.

As light is introduced into the interior of the transparent base plate 3 from the outside in the daytime, it is reflected at the half mirrors on the name portions 5. This makes it possible to allow a person standing in front of the display plate to visually recognize a shape of each of the name portions 5, i.e., a given name itself. On the other hand, when the lamp activating circuit is turned on in the nighttime, the lamp 10 is illuminated. Then, light emitted from the lamp 10 penetrates through the prism plate 7 in the transverse direction (in the perpendicular direction as seen in FIG. 1) until it is reflected at the light reflecting layer 19 on the rear surface of the prism plate 7 and emitted from the whole surface of the prism plate 7 with uniform brightness. A part of the reflected light leaked from around the dots on the light reflecting layer 19 is reflected at the heat radiating plate 14 and then emitted from the front surface of the prism plate 7 to the outside. In other words, the reflected light is emitted to the outside from the half mirrors on the name po tions 5 through the transparent plate 3. This causes only the name portions 5 to be illuminated with the result that a person standing in front of the displa; plate can visually recognize the name in a floated state.

It should be added that a plurality of display plates as constructed in the above-described manner may be arranged one above another in the vertical direction. Heat generated by the lamp 10 is conducted to the main body 1 via the heat radiating plate 14 and the cover 15 and it is then discharged to the outside. Consequently, this arrangement prevents respective components in the display plate from being excessively heated to an elevated temperature.

Next, description will be made below with reference to FIGS. 4 to 8 as to a display plate in accordance with a second embodiment of the present invention.

Figure 4:
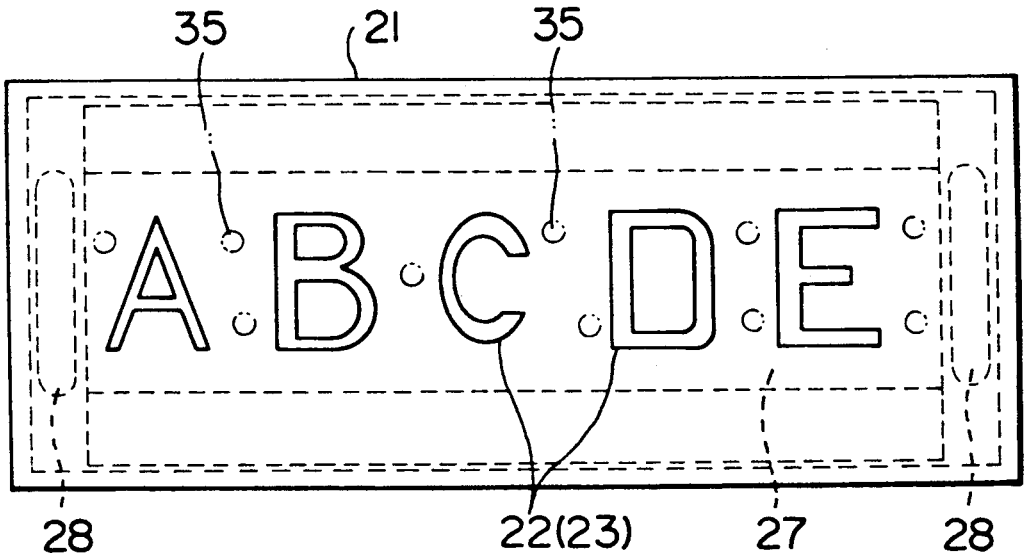
FIG. 4 is a front view of a display plate in accordance with a second embodiment of the present invention.
Figure 5:
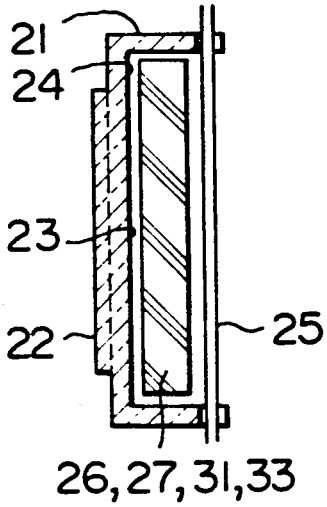
FIG. 5 is a sectional view of the display plate in FIG. 4.
Figure 6:
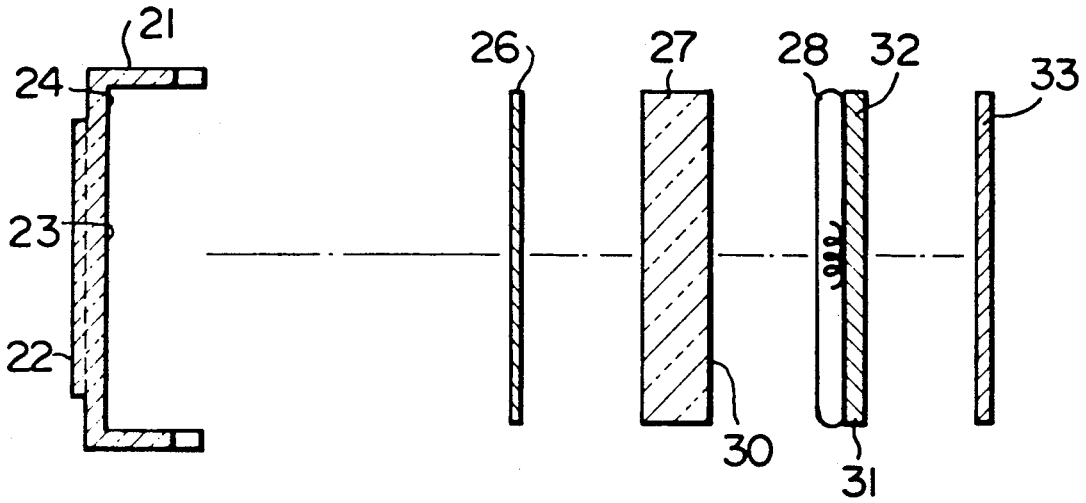
FIG. 6 is a sectional view of the display plate in FIG. 4, particularly essential components constituting the display plate in a disassembled state.
Figure 7:
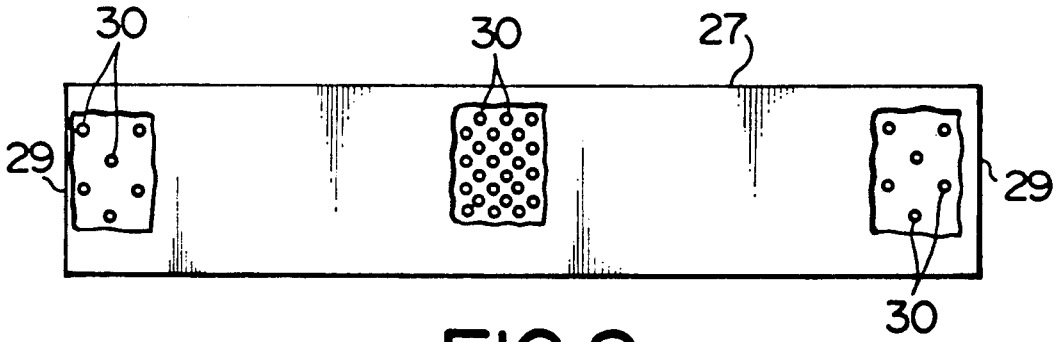
FIG. 7 is a rear view of the display plate, particularly illustrating the rear surface of a prism plate as seen from the back side.
Figure 8:
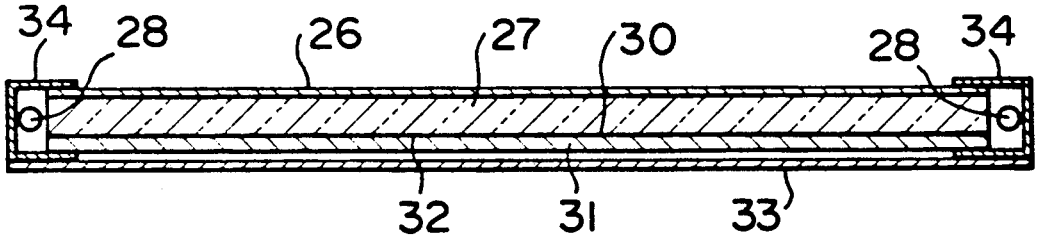
FIG. 8 is a cross-sectional view of the display plate, particularly illustrating essential components constituting the display plate.

In FIGS. 4 to 6, reference numeral 21 designates an elongated transparent base plate of which sectional shape is designed in the cup-shaped configuration. A content 22 to be displayed in the form of an image pattern or characters is provided by projecting forward of the front surface of the transparent base plate 21. In addition, half mirrors 23 are formed on the rear surface of the transparent base plate 21 in accordance with a vapor depositing process corresponding to the contour of the content 22 to be displayed. Other parts of the transparent base plate 21 exclusive of the half mirrors 23 are coated with opaque paint 24 or the like material by employing certain known means. The transparent base plate 21 is attached to a main body 25. A color filter 26 serving to scatter light and a prism plate 27 are received in the cup-shaped cavity of the transparent base plate 21. To assure that light is scattered, one surface of the color filter 26 is processed to a pearlgrained state and the color filter 26 itself is colored with a required kind of color. The prism plate 27 is made of transparent acrylic resin or the like material. As shown in FIGS. 7 and 8, the prism plate 27 includes fitting portions for holding lamps 28 at opposite ends thereof. In addition, a light reflecting layer 30 is formed on the rear surface of the prism plate 27 in such a manner that a light density of dots per unit area to be described later increases more and more as a distance of each of the dots from the lamp 28 increases. Specifically, the light reflecting layer 30 comprises a number of dots each of which is coated on the rear surface of the prism plate 27 using ink having a high reflection coefficient, and a light density of each of the dots per unit area is determined such that light from each lamp 28 is emitted from the front surface of the prism plate 27 with uniform brightness. However, the present invention should not be limited only to this arrangement of the dots. Alternatively, a plurality of lines may be substituted for a large number of dots. Additionally, the number of dots or lines may be varied and moreover a diameter of each dot or a width of each line may be changed as required.

A printed wiring board 31 is additionally disposed behind the rear surface of the prism plate 27 to provide a lamp activating circuit (not shown) for the lamps 28. One surface of the printed board 31 adapted to come in contact with the prism plate 27 is coated with ink having a high light reflection coefficient to build a light reflecting layer 32 by a coating process or the like so as to allow the light reflecting layer 32 to serve also as a light reflecting plate. The printed wiring board 31 is fixedly provided with lamps 28, e.g., incandescent lamps at opposite ends thereof. In addition, a back plate 33 is attached to the rear surface of the printed wiring board 31. The back plate 33 is made of material having an excellent heat conductivity, e.g., aluminum or the like metallic material so as to allow it to serve also as a heat radiating plate. As shown in FIG. 8, the lamps 28 are surrounded by a lamp housing 34 serving also as a heat radiating plate, respectively, after they are fitted to lamp fitting portions 29 on the prism plate 27.

Next, operation of the display plate in accordance with the second embodiment of the present invention will be described below.

When the lamps 28 are turned on in the nighttime, light emitted from the lamps 28 penetrates through the interior of the prism plate 27 from the opposite ends of the latter. As light penetrates through the prism plate 27, it is reflected at the light reflecting layer 30 in intermediate locations of the prism plate 27 and then emitted from the front surface of the prism plate 27 to the outside in the same manner in the first embodiment of the present invention. Since the light reflecting layer 30 has a light density of each of the dots per unit area as described above, light is emitted from the whole surface of the prism plate 27 with uniform brightness. A part of the light emitted from the lamps 28 leaks from around the dots. However, it is reflected at the light reflecting layer 32 of the printed wiring board 31 and penetrates through the prism plate 27 so that it is finally emitted from the surface of the prism plate 27 to the outside. Further, light reflected from the prism plate 27 is emitted to the outside from the half mirror 33 via the color filter 26. Consequently, a content 22 to be displayed can be illuminated.

On the other hand, the lamps 28 are turned off in the daytime. However, light from the outside is reflected at the half mirror 23 so that the content 22 to be displayed can visually recognized by a person standing in front of the display plate.

Heat generated by the lamps 28 is conducted to the lamp housings 34 and the back plate 33 and radiated to the outside mainly from the back plate 33.

As shown in FIG. 4, a plurality of light-emitting diodes 35 may be arranged at suitable locations on the printed wiring board 31 to enhance a decorative effect of the display plate when they are turned on. In this case, the opaque paint 24 is removed from locations on the base plate 21 corresponding to the light-emitting diodes 35 to build half mirrors thereon.

As will be apparent from the above description, the display plate of the present invention can reliably be recognized and read by a person standing in front of the display plate not only in the nighttime but also in the daytime. In addition, the display plate has an excellent decorative effect and can be designed in a thin-walled structure so as to allow it to be installed at a predetermined position depending on the manner wherein the display plate is used.

While the present invention has been described above with respect to two preferred embodiments, it should of course be understood that it should not be limited only to them but various changes or modifications may be made in an acceptable manner without departure from the scope of the invention as defined by the appended claims.

What is claimed is:

1. A display plate for displaying a certain name or a certain image pattern, said display plate comprising:

a main body;

a transparent base plate of transparent resin material, said transparent base plate being received in a fitting portion in the form of a cavity in said main body, said transparent base plate being provided with a plurality of half mirrors of which contour is determined corresponding to a content to be displayed, other parts of said transparent base plate exclusive of said half mirrors being coated with opaque paint, a prism plate attached to the rear surface of the transparent base plate, said prism plate being formed with a plurality of light reflecting layers on the rear surface thereof in such a manner that a light density per unit area on each light reflecting layer increases as a function of the distance from a lamp increases, a color filter interposed between the transparent base plate and the prism plate, one surface of said color filter being prepared in such a manner as to scatter light therefrom, and a lamp received in a cavity of the prism plate at the central part of the transparent base plate to emit light in the direction at a right angle relative to a width of the display plate.

2. The display plate as claimed in claim 1, wherein each of said light reflecting layers on the prism plate comprises a plurality of dots.

3. The display plate as claimed in claim 1, wherein a heat radiating plate serving also as a light reflecting plate is additionally disposed behind the rear surface of the prism plate for holding the lamp from the back side.

4. The display plate as claimed in claim 1, wherein said prism plate comprises a single prism plate.

5. A display plate for displaying a certain name or a certain image pattern, said display plate comprising:

an elongated transparent base plate having a sectional shape contoured in a cup-shaped configuration, said transparent base plate including a content to be displayed in the form of an image pattern or characters projecting forward of the front surface thereof, the transparent base plate being formed with a plurality of half mirrors on the rear surface thereof corresponding to said content to be displayed, other parts of the transparent base plate exclusive of said half mirrors being coated with opaque ink, a prism plate of transparent resin material received in a cup-shaped cavity of the transparent base plate, said prism plate having a plurality of light reflecting layers formed on the rear surface thereof in such a manner that a light density per unit area on each light reflecting layer increases as the function of the distance from each lamp increases, a color filter interposed between the transparent base plate and the prism plate, one surface ;of said color filter being prepared in such a manner as to scatter light therefrom, and two lamps disposed at opposite ends of the transparent base plate to irradiate light in the direction at a right angle relative to a width of display plate.

6. The display plate as claimed in claim 5, wherein each of said light reflecting layers on the prism plate comprises a plurality of dots.

7. The display plate as claimed in claim 5, wherein a printed wiring board is additionally disposed behind the rear surface of the prism plate to provide a lamp activating circuit for the lamps and one surface of said printed wiring board adapted to come in contact with the prism plate is coated with ink having a high light reflecting coefficient to build a light reflecting layer so as to allow said light reflecting layer to serve also as a light reflecting plate.

8. The display plate as claimed in claim 7, further comprising a back plate made of metallic material having excellent heat conductivity being attached to the rear surface of the printed wiring board to serve as a heat radiating plate.

9. The display plate as claimed in claim 5, wherein said prism plate comprises a single prism plate.

* * * * *